US006136103A

United States Patent [19]

Boegel et al.

[11] Patent Number: 6,136,103

[45] Date of Patent: Oct. 24, 2000

[54] COPPER-TIN-TITANIUM ALLOY

[75] Inventors: Andreas Boegel, Weissenhorn; Stephan Hansmann, Ulm; Uwe Hofmann, Neu-Ulm; Hilmar R. Mueller, Bellenberg; Joachim Riedle, Bad Wurzach, all of Germany

[73] Assignee: Wieland-Werke AG, Ulm, Germany

[21] Appl. No.: 09/212,524

[22] Filed: Dec. 16, 1998

[30] Foreign Application Priority Data

Dec. 19, 1997 [DE] Germany ..... 197 56 815

[51] Int. Cl.[7] ..... C22C 9/02

[52] U.S. Cl. ..... 148/433; 420/470

[58] Field of Search ..... 148/433; 420/470–476

[56] References Cited

U.S. PATENT DOCUMENTS 5,004,581 4/1991 Takagi et al. ..... 148/433

5,102,621 4/1992 Sara ..... 420/470

*Primary Examiner*—Deborah Yee

*Attorney, Agent, or Firm*—Flynn, Thiel, Boutell & Tanis, P.C.

[57] ABSTRACT

A copper-tin-titanium alloy which consists of 12 to 20% by weight tin, 0.002 to 1% by weight titanium, remainder copper and usual impurities. It is possible to add further elements. Semifinished products made from the copper alloy according to the invention are preferably produced by thin-strip casting or spray compacting. Due to a particularly advantageous combination of high mechanical strength properties with excellent ductility, combined with good resistance to corrosion, semifinished products made from the copper alloy according to the invention have numerous possible uses.

17 Claims, No Drawings

COPPER-TIN-TITANIUM ALLOY

FIELD OF THE INVENTION

The invention relates to a Cu—Sn—Ti alloy, to its production and to its use. The Cn—Sn—Ti alloy consists of 12–20% by weight Sn, 0.002–1.0% by weight Ti, with the remainder Cu and usual impurities. If it is cooled sufficiently rapidly from the molten state, such an alloy can be obtained, at room temperature, with a microstructural condition which is such that the preform (cast strip, cast ingot, cast bolt) which is present for producing the semifinished product is technically free of coarse, brittle phases and is therefore particularly suitable for the production of semifinished products such as strips, sections, wires, hollow sections or tubes by working. Such semifinished products are eminently suitable for producing various objects which are in daily use and components which are used in precision mechanics and electromechanics, as well as in general mechanical engineering. Due to its chemical composition and the way in which it is produced, such an alloy has a particularly advantageous combination of high mechanical strength properties with excellent ductility, combined with a good resistance to corrosion.

BACKGROUND OF THE INVENTION

According to the current state of the art, the demands placed on modern semifinished products result both from use and environmental properties and from cost aspects. Due to the pressure of competition, therefore, materials which allow economical production which are as far as possible free of waste appear attractive. Consequently, in many cases, workable materials, in particular, appear to be particularly advantageous by comparison with cast materials in the case of Cu alloys if complex functional components are being produced. However, the workability of Cu materials limits the use of highly valued properties of cast materials, among which the Cu—Sn materials play a particularly important role. They are distinguished, for example, by very high strength and hardness properties combined with very good corrosion properties and a generally excellent suitability for tribological requirements. The treatment and composition of the tin bronzes are described extremely extensively in the literature (e.g. K. Dies, Kupfer und Kupferlegierung in der Technik [Copper and copper alloy in engineering], Berlin 1967 page 504 ff.). This reference also deals with the possibility of achieving homogenous microstructures even in cast bronzes which contain up to about 15% by weight Sn by means of heat treatment. It is explained in that reference that homogenization treatments lead to pores (loc. cit. pp. 514–516), while, on the other hand, mechanical properties can be improved by homogenization, without there being any reference to this allowing cold-working (loc. cit. pp. 549 ff). Consequently, conventionally produced bronzes with a high tin content have to be homogenized in order to be worked, and therefore contain pores. It is known to the person skilled in the art that pores are undesirable for most technical applications. They form weak points under mechanical load and impair the working itself, or, after having been worked, at least prevent a flawless surface from being formed. For this reason, the prior art does not allow the use of cast bronzes as workable materials. Hitherto, it has been necessary to regard the contrast between workable and cast materials as impossible to overcome, although the availability of a workable material having the properties of a cast material has been regarded as desirable.

SUMMARY OF THE INVENTION

Therefore, the object of the present invention is to propose a material and a process for its production which overcomes the contrast between the workable CuSn materials and the cast CuSn materials. It is intended that the material should combine the chemical and mechanical properties of the cast bronzes with the machining properties of the workable materials, which in particular requires the cold-workability to be established while at the same time ensuring high mechanical strength and hardness.

According to the invention, the object is achieved by means of a Cn—Sn—Ti alloy which is cooled so rapidly from the molten state that the segregation which is normally found in castings is not present and that the microstructure is free from macroscopic segregations at room temperature. Macroscopic segregations are understood to mean microstructural constituents which are present in the cast microstructure and form more than 10% by volume and, as individual phase fields, have a dimension of greater than 1 mm. A cooling rate between liquidus temperature and solidus temperature which is sufficiently high to avoid such macrosegregations can be achieved by various techniques. These include strip casting (cf. for example: Vaught, C. F.: Apparatus of and Apparatus for Continuous Casting of a Metal Strip, USA Patent Specification WO 87/02285 (1987); Wünnenberg K., Frommann, K., Voss-Spilker, P.: Vorrichtung zum kontinuierlichen Gießen von breitem Band [Device for the continuous casting of wide strip], DE laid-open specification 3,601,338 A1 (1987)) and spray compacting (cf. for example: GB Patent 1,379,261, Reginald Gwyn Brooks, (1972), GB Patent 1,599,392, Osprey Metals Ltd., (1978), European Patent 0,225,732, Osprey Metals Ltd., (1986)). The microstructural condition of the preforms produced using these processes differs considerably from, for example, preforms produced by conventional extrusion. They are eminently suitable for hot-working and cold-working, as explained, for example, in DE 4,126,079 "Bandgießverfahren für ausscheidungsbildende und/oder spannungsempfindliche und/oder seigerungsanfällige Kupferlegierungen [Strip-casting process for copper alloys which form precipitation and/or are sensitive to stresses and/or are susceptible to segregation]" and DE 4,201,065 "Anwendung des Sprühkompaktier-Verfahrens zur Verbesserung der Biegewechselfestigkeit von Halbzeug aus Kupferlegierungen [Use of the spray compacting process for improving the fatigue strength under reverse bending stresses of semifinished products made from copper alloys] ". However, the compositions referred to in those documents do not relate to typical cast alloys. Surprisingly, however, it has now been possible to establish that the susceptibility of even the cast tin bronzes which are defined, for example, in DIN to form flaws and pores, but also to form segregations, can be reduced, by adding titanium or zirconium and iron, to such an extent that the preforms produced in this way can then be utilized industrially by being worked. Further embodiments, which will be explained below, which contain further added alloying components also make it possible to advantageously establish important properties for the mechanical functioning and corrosion resistance.

DETAILED DESCRIPTION

For conventional cast tin bronzes, both hot-working and cold-working are impossible or are possible only to a very limited extent. By contrast, the alloys which are produced according to the invention make it possible, in the cold state, to change the cross section in a controlled manner in the cast state by at least 20% or allow a reference amount of deformation of at least $\phi=0.25$ ($\phi$: in A0/A1; A0: cross section prior to cold-working; A1: cross section following cold-working).

The use of conventional cast alloys is out of the question for hot-working, due to the segregation of phases which are molten at the process temperature and cause destruction of the workpiece, or due to the phases which are brittle at lower process temperatures and either increase the deformation resistance to such an extent that the materials can no longer be worked using mechanical engineering techniques or cause the workpiece to shear off and be destroyed. By contrast, the preforms produced according to the invention make it possible to use hot-working processes which entail considerable change in the cross-section. In this context, processes in which compressive stress is predominant, such as pressing and rolling to form circles, are particularly recommended.

Therefore, if the novel alloy compositions of this type are made available as industrial preforms, they are suitable for hot-working by means of rolling, pressing and forging as well as deformation processes which are derived from these basic forms. At room temperature, the castings which have previously been hot-worked, but also the castings themselves, can be worked by rolling, drawing, hammering, stamping, deep-drawing and deformation processes derived from these, such as pilgrim rolling, flanging, straight knurling and bending.

This results in the following individual steps for applying the processes according to the invention to the alloys according to the invention:

1. Production of the preform 1.1 Thin-strip casting

To produce thin strips with a thickness of 2 to 25 mm 1.2 Spray compacting 1.2.1 To produce flat shapes or strips with a thickness of up to 250 mm 1.2.2 To produce tubes with wall thicknesses of up to 100 mm 1.2.3 To produce cylindrical bodies of up to 600 mm which may be used, for example, as bolts for extrusion 1.3 Metal-removing machining of the preform 2. Further processing of the preform 2.1 Hot-working For rolling processes, hot-forming in the temperature range from 600–800° C. is recommended, for pressing processes the temperature range from 550–800° C. is recommended.

2.2 Cold-working

Controlled changes in cross-section of up to 95% and reference amounts of deformation of up to $\phi=3$ are possible. For the preform, controlled changes in cross-section of at least 20% or reference amounts of deformation of at least $\phi=0.25$ are typically tolerated.

2.3 Intermediate annealing operations for recrystallization and for recovering the capacity for deformation Annealing operations in the temperature range of between 400 and 700° C. for from 1 minute to 10 hours are suitable for this purpose.

2.4 Concluding cold-working

For a concluding cold-working operation, controlled changes in cross-section of typically up to 95% are possible following preceding intermediate annealing.

2.5 Concluding heat treatment

A concluding heat treatment is carried out in order to have a positive effect on the internal stress state by means of thermal treatment or in order to have a beneficial effect on the mechanical properties by means of tempering or soft-annealing treatment, or in order to additionally establish, for example, tribological or machining properties which are required by the controlled establishment of heterogeneous phases.

2.5.1 Tempering

The tempering is carried out in the temperature range of 150–300° C. for periods of between 1 minute and 10 hours.

2.5.2 Recovery and recrystallization annealing operations are carried out in the temperature range from 300–700° C., with annealing durations of from 1 minute to 10 hours.

2.5.3 Heterogenization

Heterogenization treatments are carried out in order to establish the equilibrium phases in the temperature range of 700–900° C., with annealing durations of at least 1 minute up to 10 hours. They are used in particular to establish high hardness levels or for microstructural differentiation, which serves predominantly to optimize tribological properties.

As has been stated, the selection of the preform and the following combination of production steps takes place on the basis of the benefits provided and economic considerations.

Preforms according to 1.1 are preferably processed further without a hot-working stage. For the other preforms, a hot-working stage is preferred in order to reduce the cross-section more quickly and to a greater extent.

The sequence of cold-working operations and intermediate annealing operations in accordance with 2.2 and 2.3 serves to produce the desired semifinished products and to establish their dimensions and, if necessary, can be repeated. The cold-working and final treatments are used, in the production of semifinished products, to establish desired geometric and mechanical properties in order for the semifinished product to be used directly or for it to be improved further, for example by being coated, plated or producing material bonds.

In addition to the process aspects, however, the following aspects are also to be taken into account when selecting the composition.

The Sn content which has proven useful for use in the present invention in the cast bronzes sector extends from about 12 to 20% by weight. The higher the tin content, the higher the mechanical properties can become.

At least 0.002% by weight titanium and/or zirconium is required in order to ensure the required homogeneity of the microstructure. The total level of these materials should not exceed 1% by weight, since higher levels would have a very adverse effect on the surface properties. In the production and utilization of semifinished products, this fact manifests itself in a considerable tendency to form oxides, which are highly liable to have adverse effects on the following coating or improvement operations.

Iron contents of from 0.005 to 2% by weight serve to assist with forming the homogenous microstructure, and in addition, this iron, alone and by forming compounds with Sn and interacting with aluminum, titanium, zirconium and phosphorus, contributes to the thermal stabilization of the material under a thermal load. Iron contents of greater than 2% by weight should be avoided, since they entail a high risk of large bands of iron or separate iron particles, which would have an adverse effect on the formation of flawless surfaces. The usual replacement for iron is cobalt, of which the same is true.

Depending on which production facilities are available, phosphorus may be required in order to pre-deoxidize the melt or, by interacting with Fe and Ti, may contribute to the thermal stabilization of the material. Residual contents, following pre-deoxidization, of less than 0.001% by weight are as a rule insufficient, while levels of greater than 0.4% do not offer any further advantages either for the deoxidization or for the thermal stabilization.

Nickel contents of up to 5% by weight seem to be worth recommending, where-necessary, for improving the strength properties and increasing the corrosion resistance. Nickel contents above 5% by weight make the material difficult to handle, since they have a noticeable adverse effect on the age-hardenability of known Cu—Ni—Sn materials.

Magnesium contents of up to 1% by weight may additionally be employed in a similar manner to titanium, zirconium of phosphorus. The comments made with regard to titanium and zirconium apply from the point of view of limiting the magnesium content. In addition, the formation of compounds on the part of magnesium and phosphorus and the considerable tendency of magnesium to enhance the temper-hardening can be used to thermally stabilize the material.

Up to 2% by weight aluminum may advantageously be used in order to enhance the temper-hardening and/or to increase the mechanical characteristic data. Adding aluminum has proven advantageous for handling the melt if it is necessary to set the viscosity at a low level, because residual oxygen contents, interacting in particular with titanium and magnesium, have made the melt viscous. Aluminum levels of greater than 2% by weight have an adverse effect on subsequent surface-treatment operations, such as for example electro-plating, and also make soldering or welding more difficult, and should therefore be avoided.

Limited manganese and zinc contents of up to 5% by weight may appear desirable in order to reduce the metal value of the material. Manganese, in particular, is also a possibility for increasing the machinability, since the presence of manganese is suitable for further enhancing in particular the plastic deformability.

Chip-breaking additions of lead and/or carbon in the form of graphite, forming up to 3% by volume, are advisable in order to establish the machining properties. Furthermore, they are also important in ensuring emergency running properties in components which are susceptible to sliding loads. However, levels of over 3% by volume lead to drawbacks with regard to the plastic deformability and mechanical loadability, so that they are not to be considered within the context of the present invention.

The invention is explained on the basis of the following example:

In electromechanics, for springs, or, for example, in precision mechanics for spectacle bows which are subject to high loads, a material in wire form which is as strong as possible but ductile is desired. Tin bronzes are eminently suitable for this purpose. The higher the tin content of these bronzes, the higher the strength characteristics which are achieved become. Conventional workable tin bronzes seldom contain more than 9% by weight tin, and are therefore considered unsatisfactory. Tin bronzes with very high levels of tin, e.g. 15% by weight, are now available as workable materials by employing the present invention.

In order to produce a semifinished product in wire form made from a copper alloy, a CuSn16Ti bolt, the composition of which was 15.5% by weight Sn, 0.25% by weight Ti, 84.15% by weight Cu (remainder usual impurities), was produced using a spray compacting installation made by Mannesmann-Demag under license from Osprey Metals. To do this, the composition was melted in a vacuum furnace in order to avoid the undesired slagging of Ti. The gas/metal ratio set during spraying was 0.5 $Nm^3$/kg. The ultimate dimensions were diameter 480 mm, length 1200 mm.

Metallographic examination showed the microstructure in the sprayed state to be free of segregation. The preform produced in this way was machined with the removal of metal on all sides, in order to remove the outer porous layer caused by spraying and to produce a cylindrical body for extrusion. This so-called bolt was then formed, at 670° C., into two wires with a diameter of 16.3 mm by means of a direct-action extrusion press. The wires were then thermomechanically treated by:

1. Pickling in sulfuric acid
2. Cold-working by rolling, with $\phi$=0.5
3. Recrystallizing intermediate annealing, 560° C. for 4 hours.

Steps 1 to 3 were carried out repeatedly, until a wire preform with a diameter of 5.2 mm was present. The degree of deformation is was limited by the considerable strengthening of the material to yield strengths of over 850 MPa at relatively high degrees of deformation. Although the material would still tolerate such levels, as preliminary trials in the laboratory have shown, the working technology of the equipment used meant that it was only possible to achieve the degree of deformation mentioned above. The wire preforms were then converted to their final dimensions by the following process steps:

4. Pickling in sulfuric acid
5. Cold-working by drawing to a diameter of 3.8 mm
6. Recrystallizing intermediate annealing, 560° C. for 4 hours
7. Finishing drawing to 2.3 mm and were then present in the form of a round wire with a diameter of 2.3 mm of drawing hardness, for example for electromechanical components, and, following a concluding recrystallizing final annealing under a hydrogen atmosphere, with subsequent bright pickling, as a round wire with a diameter of 2.3 mm, soft for production purposes, e.g. for the spectacle components mentioned above.

Metallographic inspection showed a microstructure which was free from segregation and contained fine precipitation. The wires had the following characteristic variables:

Of drawing hardness: tensile strength 930 MPa, yield strength 810 MPa, elongation at break A5 18%, hardness 240 $H_v10$, modulus of elasticity 80 GPa.

Soft: tensile strength 490 MPa, yield strength 240 MPa, elongation at break A5 62%, hardness 100 $H_v10$, particle size 40 $\mu$m.

For suitability for use, an advantage is provided, in addition to the very high mechanical characteristic variables, by applying the process according to the invention to the alloy according to the invention. The ratio between yield strength and modulus of elasticity becomes so high that it reaches a level which can scarcely be reached with conventional workable copper alloys. As a result, for resilient stresses, the deformations which can be tolerated elastically become very high, which can immediately be used to good effect in maximizing spring excursions. This is of very great interest for spectacle bows, for example, since inadvertent bending does not immediately lead to the user's correct fitting being lost.

Two further advantages are found after a brief thermal load, as is entirely customary, for example, in joining work carried out by soldering or welding. To demonstrate this, using the procedure described above, a CuSn14 alloy, which is not according to the invention, containing 13.8% by weight tin, with the remainder copper and usual impurities, was made into a 2.3 mm thick wire using the procedure according to the invention. Wires made from CuSn4, CuSn6 and CuSn8 were produced to this dimension on the basis of preform material which has been produced by conventional methods. The wires were then annealed in a salt bath. For further comparative purposes, in addition, the characteristic variables determined on castings were given for two DIN casting alloys with a high tin content.

| Material | Hardness after cold-working with a controlled change in cross-section of approx. 40% | Hardness after brief thermal load 700° C./3 min | Particle size after brief thermal load 700° C./3 min |
|---|---|---|---|
| CuSn4 (workable material) | 180 $H_V10$ | 80 $H_V10$ | 60 μm |
| CuSn6 (workable material) | 185 $H_V10$ | 90 $H_V10$ | 70 μm |
| CuSn8 (workable material) | 195 $H_V10$ | 95 $H_V10$ | 60 μm |
| GC-CuSn12Ni (cast material in accordance with DIN 1705) | Hardness in the cast state 100 $H_B10$ | 100 $H_B10$ | over 1 mm |
| GC-CuSn12Pb (cast material in accordance with DIN 1705) | Hardness in the cast state 95 $H_B10$ | 95 $H_B10$ | over 1 mm |
| CuSn14 (only using the process according to the invention) | 210 $H_V10$ | 100 $H_V10$ | 125 μm |
| CuSn16Ti (applying the process to the alloy according to the invention) | 240 $H_V10$ | 140 $H_V10$ | 40 μm |

As can be seen, the hardness for the material according to this invention remains at a considerably higher level and the particle size is considerably smaller than for materials which are not according to the invention, even if the procedure according to the invention is employed in order to utilize higher tin contents. At the same time, the comparison with the cast materials also comes down in favor of the invention: the grain size is finer and the hardness is higher, even after being briefly subjected to a temperature of 700° C.

The performance of the material according to the invention and produced using the process according to the invention is always advantageous if, following joining work, it is intended to maintain strength properties which are as high as possible and the suitability for use must not be limited, with regard to mechanical loads or questions of surface treatment, by the formation of coarse grains.

Using these results, it is therefore possible to demonstrate that the combination of the proposed process with the proposed compositions leads to properties which otherwise could only be achieved for cast materials: very high tin contents, and very high strength properties, even after thermal loading. On the other hand, at the same time, the benefits of workable materials are achieved: small particle size, high strength brought about by cold-working, considerable variability in the dimensions of the semifinished products as a result of thermomechanical treatability. Consequently, the object of the invention is achieved.

We claim:

1. A wrought copper-tin-titanium alloy consisting of

12–20 wt. % tin, 0.002–1 wt. % in total of at least one of titanium and zirconium, optionally, 0.005–2 wt. % in total of at least one of iron and cobalt, optionally, up to 5 wt. % nickel, optionally, up to 1 wt. % magnesium, optionally, up to 2 wt. % aluminum, optionally, up to 5 wt. % in total of at least one of manganese and zinc, optionally, up to 3 vol. % in total of at least one of lead and carbon as chip breakers, with the remainder being copper and impurities.

2. The wrought copper alloy as claimed in claim 1, wherein titanium is present in an amount of 0.002–1 wt. %.

3. A wrought copper-tin-titanium alloy consisting of 12–20 wt. % tin, 0.002–1 wt. % titanium, with the remainder being copper and impurities.

4. The wrought copper alloy as claimed in claim 2 wherein the titanium is completely or partially replaced by zirconium.

5. The wrought copper alloy as claimed in claim 1, which additionally contains 0.005 to 2% by weight iron.

6. The wrought copper alloy as claimed in claim 5, wherein the iron is completely or partially replaced by cobalt.

7. The wrought copper alloy as claimed in claim 1, which additionally contains up to 5% by weight nickel.

8. The wrought copper alloy as claimed in claim 1, which additionally contains up to 1% by weight magnesium.

9. The wrought copper alloy as claimed in claim 1, which additionally contains up to 2% by weight aluminum.

10. The wrought copper alloy as claimed in claim 1, which additionally contains manganese and zinc, individually or together, up to a maximum content of 5% by weight.

11. The wrought copper alloy as claimed in claim 1, which additionally contains up to 3% by volume of lead and/or carbon as chip breakers.

12. A process for producing a semifinished product in strip, wire, section or tube form, from the copper alloy as claimed in claim 1, wherein a preform is produced by thin-strip casting or spray compacting, which is then subjected to hot-working and/or cold-working steps, if appropriate with intermediate annealing operations.

13. In a method of producing an article selected from the group consisting of jewelry, clothing accessories, spectacle bows, spectacle hinges, eye-rim profiles, parts for wristwatch straps and wristwatch casings, the improvement comprising the step of manufacturing said article from the semifinished product of claim 12.

14. In a method of producing an electromechanical component selected from the group consisting of relay springs, switching elements, contacts, plug connectors, semiconductor supports and commutators, the improvement comprising manufacturing said electromechanical component from the semifinished product of claim 12.

15. In a method of producing a functional component selected from the group consisting of levers, gearwheels, worm wheels, rollers, spindle nuts and springs, the improvement comprising manufacturing said functional component from the semifinished product of claim 12.

16. In a method of producing an article selected from the group consisting of sliding-contact bearings, clutch pieces and friction plates, the improvement comprising manufacturing said article from the semifinished product of claim 12.

17. In a method of producing a valve, the improvement comprising manufacturing said valve from the semifinished product of claim 12.

* * * * *